US005730287A

United States Patent [19]

Martin

[11] Patent Number: 5,730,287

[45] Date of Patent: Mar. 24, 1998

[54] FOOTBALL CARRIER/PROTECTOR

[75] Inventor: Joe Leslie Martin, Sapulpa, Okla.

[73] Assignee: Joe L. Martin, Sapulpa, Okla.

[21] Appl. No.: 614,483

[22] Filed: Mar. 13, 1996

[51] Int. Cl.[6] ..... B65D 85/00

[52] U.S. Cl. ..... 206/315.9; 294/170

[58] Field of Search ..... 206/315.1, 315.9, 206/315.91; 190/115; 150/107, 109, 110; 294/146, 148, 149, 150, 152, 170

[56] References Cited

U.S. PATENT DOCUMENTS 4,042,156 8/1977 Knight ..... 206/315.9 X 5,139,189 8/1992 Hanley ..... 206/315.9 X

*Primary Examiner*—Jacob K. Ackun

[57] ABSTRACT

The invention relates to a multiple gameball carrier/protector. It contains two pouches made out of a resilient and waterproof material. Each pouch consist of one relatively oval shaped member. One side of the oval shaped member will be non-releasably attached to the other side of the oval shaped member. This will create a pouch like device with an enclosement at one end of the pouch and an opening at the opposite end of the pouch. The size of the pouches will be smaller than than the size of the gameball. Once the gameball is in the pouch the material will have stretched and conformed to the exact shape of the gameball, therefore holding the gameball in the pouches. The length of the pouches will be slighlty shorter than the lenght of the gameball, this allows the tip of the gameball to stick out of the pouch. The invention also serves as a protector from the weather, such as rain or snow. The invention will have a strip of velcro attached to the rope or cord for extra attachments.

1 Claim, 3 Drawing Sheets

FOOTBALL CARRIER/PROTECTOR

BACKGROUND OF THE INVENTION

The invention relates to a multiple carrier/protector. Quite often we are needed to carry a gameball or a multiple of gameballs from one destination to another. This invention will allow the gameballs to be placed in individual pouches connected by a rope or cord and be laced over the shoulder for easy transportation. Having no zippers, buttons, clamps, or hooks of any such, the pouches will create easy and quick access to the gameballs when needed. The waterproof pouches will allow better handling of the gameballs in poor weather conditions. Furthermore no prior art bag of this nature is able to carry more than one gameball at a time. The need to carry more than one gameball at a time can be best observed when watching a little league football practice in which more than one gameball is needed.

U.S. Pat. No. 5,085,320 to Gregory D. Scott, has a prior art device designed to carry a gameball in which two hemispherical members are connected at a point and are drawn together by a zipper or some other releasable device to form a collaspable bag it utilizes a small handle for transportation U.S. Pat. No. 5,238,162 Robert A. Lacivita has a prior art device designed to carry a gameball. It consist of a enlongated, resilient strap that stretches around the ball and uses a locking device to hold the ball in place. An attached shoulder strap is added for carrying the device.

Before the above prescribed time gameballs were usually tucked under the arms in which always involves at least one arm being out of use. Carrying bags, such as garments or duffle bags are used but they are bulky and require lots of un-needed material in manufacturing, thus the bags intended uses were not designed specifically for carrying gameballs.

SUMMARY OF THE INVENTION

A multiple game ball carrier/protector. It consist of two oval shaped pouches connected by a rope or cord at each enclosed end of each pouch. The opening of each pouch will stretch to a distance greater than the gameball, allowing the gameball to slide in and out of the pouches. Once the gameball is in the pouch the material will have stretched and conformed to the exact shape of the gameball, therefore holding the gameball in the pouches. A small portion of the gameball will stick out of the pouch, allowing quick and easy access to the gameballs.

It is the object of the invention to provide a device for carrying a gameball or a multiple of gameballs.

It is an object of the invention to provide quick and easy access to the gameballs.

It is a object of the invention to provide a carrier for gameballs that does not require any buttons, zippers, hooks, or any such locking devices to hold the gameballs in the pouches.

It is a object of the invention to provide a carrier that will protect the gameballs from poor weather conditions in game situations.

It is an additional object of the invention to provide a carrier made entirely out of a resilient material, such as neoprene, that that conforms to the exact shape of the gameball, therefor looking exactly like the gameballs being carried.

Furthermore, it is the object of the invention to provide a carrier that is quick and inexpensive to manufacture, and is readily marketable.

DETAILED DESCRIPTION OF THE DRAWING

Figure 1:
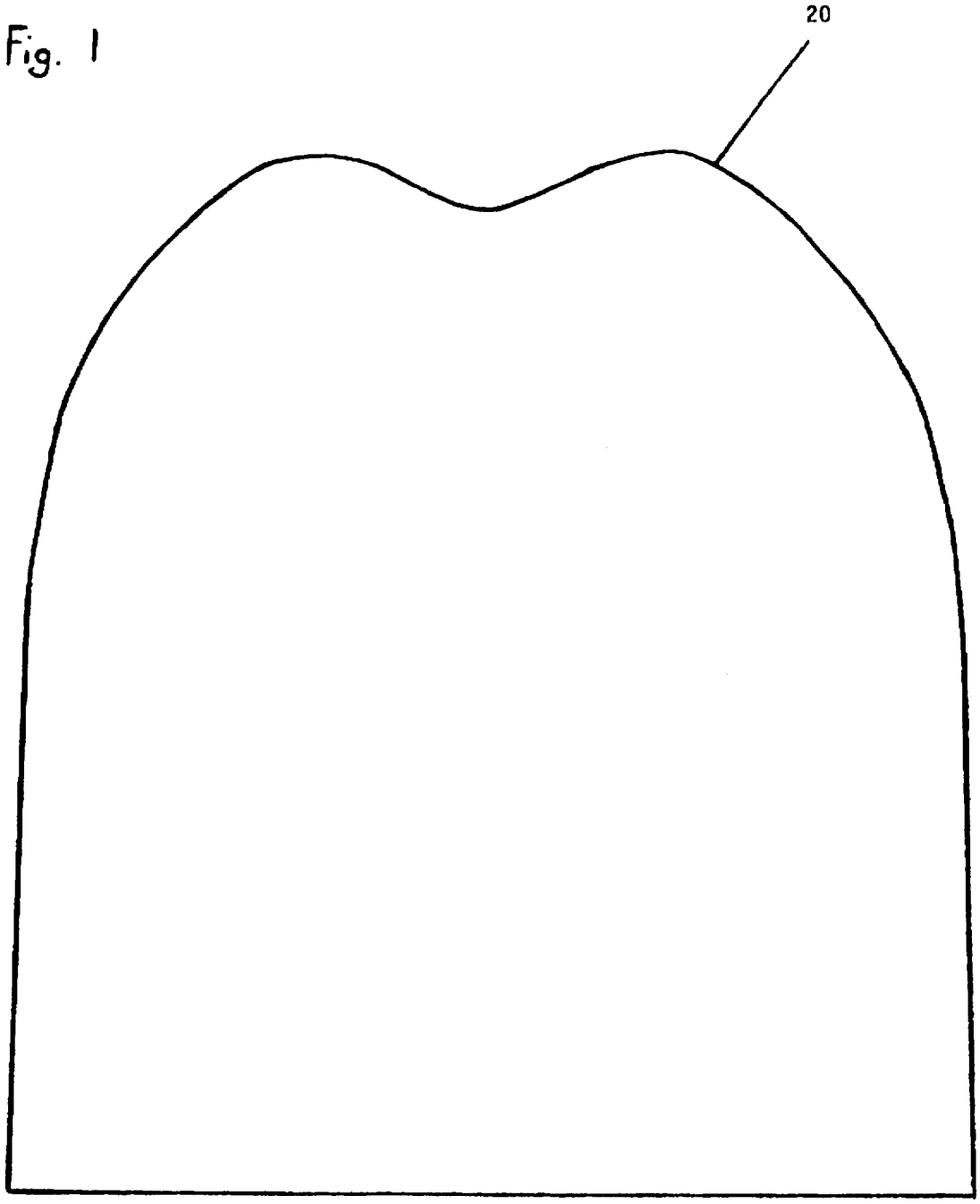
FIG. 1 is a exploited veiw of the pouch.
Figure 2:
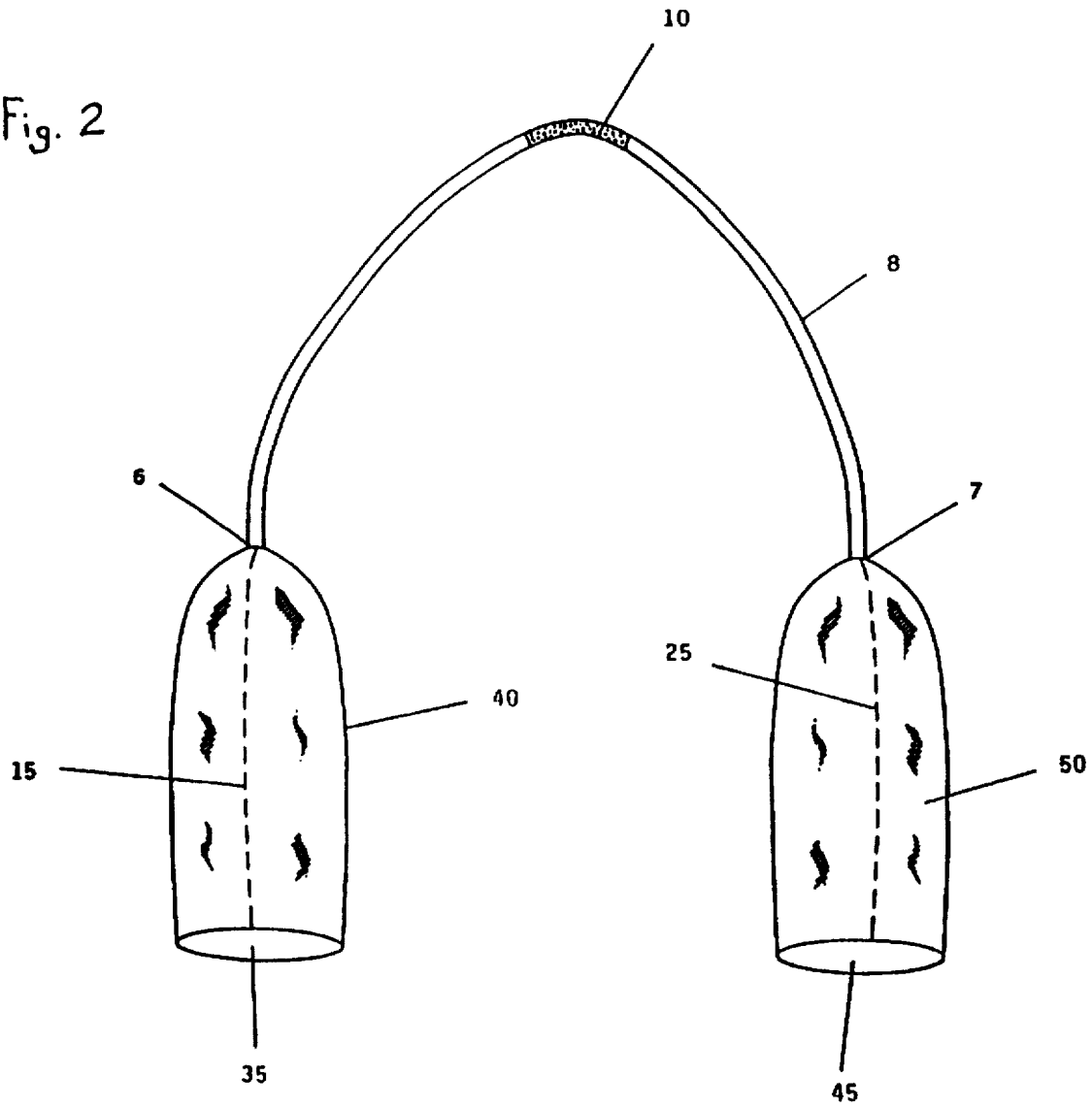
FIG. 2 is a front view of the gameball carrier/protector.
Figure 3:
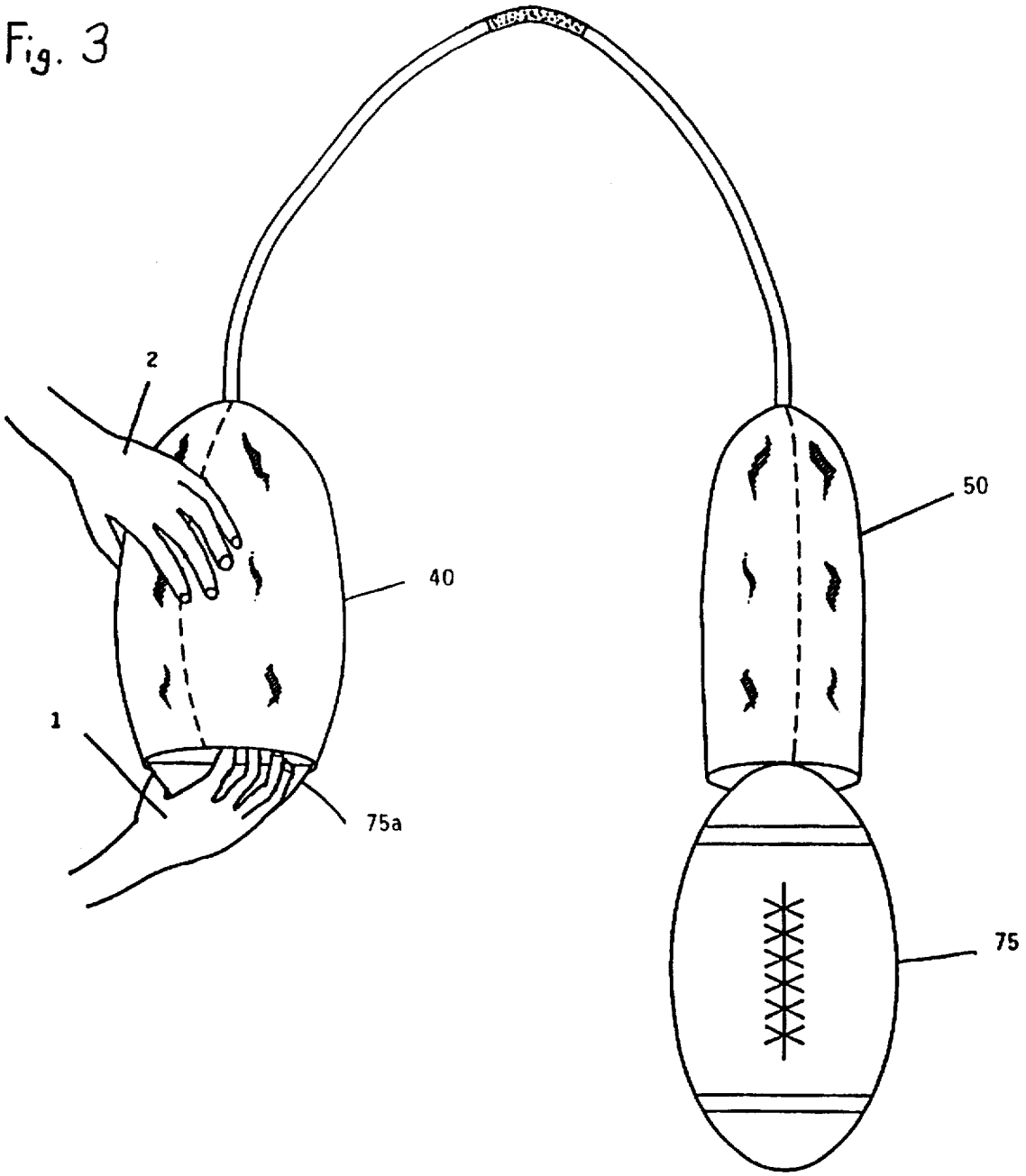
FIG. 3 is a view of the gameball carrier/protector with a football inside the pouches and being transported over the shoulder area.

FIG. 1–3 should not limit the invention to footballs only. Any such person skilled in the art could easily construct the invention to carry basketballs, soccer balls, volleyball, or any such athletic balls of such sizes..

FIG. 1, member 20 is an unassembled view of the pouch and is made of aresilient waterproof material such as neoprene. In FIG. 1 point A side of member 20 is to be non-releasably attached to point B side of member 20. It is to be sewn from where point A and B connect to point c of member 20, once the points are connected in this manner member 20 will have formed a pouch like device, as seen in FIG. 2 at points 40 and 50.

In FIG. 2 the carrier/protector 100 is shown in its entirety without a gameball in the pouches. In FIG. 2 pouch 50 is shown with an open end 45 of pouch 50 and an enclosed end 7 of pouch 50. In FIG. 2 stitching 25 shows how in FIG. 1, member 20 is non-releasably attached together to form pouch 50. In FIG. 2 the opening 45 is able to stretch to a distance greater than the gameball, allowing the gameball to slide in and out of the pouche 50. In FIG. 2 the cord 8 is non-releasably attached to pouch 50 at the enclosed end 7. Cord 8 is approximatly two feet long and has a strip of velcro 10 attached so extra carrier/protectors can be added. In FIG. 2 pouch 40 is shown with an open end 35 and an enclosed end 6. In FIG. 2 stitching 15 shows where pouch 40 is non-releasably attached together. In FIG. 2 the cord 8 is attached to pouch 40 at point 6. In FIG. 2 the open end 35 will stretch to a distance greater than the gameball, allowing the gameballs to slide in and out of pouch 40.

In FIG. 3 a football 75 represents the gameball. In FIG. 3 the football 75 has been placed in pouch 40, this shows how the tip 75*a* of the football 75 sticks out of the pouch 40. This allows easy access by simply grasping the tip 75*a* of the football 75 with one hand 1 and the pouch 40 with the other hand 2 and pulling in opposite directions. In FIG. 3 the football 75 has been placed inside the pouch 40, this shows how the pouch 40 conforms to the exact shape of the football 75. Once the football 75 is in pouch 40, the resilient material will contract and hold the football 75 in place. In FIG. 3 cord 8 can be easily tossed over the shoulder area 5 for easy transporting. The weight of pouch 40 with football 75 in tote, and the weight of pouch 50 with football 75 in tote will prevent the carrier/protector from sliding foreward or backward.

I claim:

1. A carrier for transporting more than one game ball, the carrier comprising:

two, separate oval-shaped pouches, each pouch being formed of a flexible material, and having an opening at one end of each pouch that will accept and hold firmly the game balls, the balls protrude from each open end of said pouches and are contained therein by the contour of the balls and a binding friction and resistance to movement that occurs when the outer surface of the balls comes into contact with the interior of the pouches; the length and the width of each said pouch is slightly smaller in size than the said game balls, from the open end each pouch gradually tapers to terminated ends, a cord is non-releasably attached to the terminated end of each said pouch, and permanently attached to said cord is an attachment means for additional attaching carriers to said cord.

* * * * *